US012601121B2

(12) United States Patent
Brockman et al.

(10) Patent No.: US 12,601,121 B2
(45) Date of Patent: Apr. 14, 2026

(54) CONTROL OF A WORK MACHINE USING GROUND SURFACE WORK RECORDS

(71) Applicant: Caterpillar Paving Products Inc., Brooklyn Park, MN (US)

(72) Inventors: Elizabeth R. K. Brockman, Charlotte, NC (US); Matthew Daryl Chisholm, Maple Grove, MN (US); Michael William Ries, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 198 days.

(21) Appl. No.: 18/363,383

(22) Filed: Aug. 1, 2023

(65) Prior Publication Data

US 2025/0043516 A1 Feb. 6, 2025

(51) Int. Cl.
*E01C 19/00* (2006.01)
*E01C 19/10* (2006.01)

(52) U.S. Cl.
CPC ..... *E01C 19/004* (2013.01); *E01C 19/1063* (2013.01)

(58) Field of Classification Search
None
See application file for complete search history.

(56) References Cited

U.S. PATENT DOCUMENTS 5,631,658 A 5/1997 Gudat et al.
8,899,689 B2 12/2014 Killion
11,066,791 B2 7/2021 Shelstad et al.
11,679,639 B2 6/2023 Rife, Jr. et al.
2008/0309163 A1* 12/2008 Hashimoto ..... H02J 7/00308 361/86
2013/0046419 A1* 2/2013 Anderson ..... E02F 9/2054 701/2
2016/0222602 A1 8/2016 Downing
2016/0245785 A1* 8/2016 Marsolek ..... E01C 19/48
2017/0058467 A1 3/2017 Marsolek et al.
2017/0241087 A1* 8/2017 Ellwein ..... E01C 23/01
2018/0245317 A1 8/2018 Ready-Campbell et al.
2018/0292840 A1* 10/2018 Sakai ..... G01C 21/20
2018/0355587 A1* 12/2018 Hashimoto ..... E02F 3/844
2019/0055715 A1 2/2019 Wei et al.
(Continued)

FOREIGN PATENT DOCUMENTS

CN 110457391 A 11/2019
CN 113091760 A 7/2021
(Continued)

*Primary Examiner* — Amelia Vorce

(57) ABSTRACT

A controller may obtain one or more ground surface work records from one or more databases, the one or more ground surface work records identifying information relating to at least one of base layer preparation, paving, or compacting of a ground surface performed at a worksite by a plurality of work machines. The controller may determine, based on the one or more ground surface work records, configuration information for a ground surface work operation to be performed by a work machine of the plurality of work machines. The controller may generate a signal, based on the configuration information, to cause the work machine to perform the ground surface work operation or to cause presentation of the configuration information on a display of the work machine.

15 Claims, 4 Drawing Sheets

(56) References Cited

U.S. PATENT DOCUMENTS

| | | | | |
|---|---|---|---|---|
| 2019/0101641 | A1 | 4/2019 | Hogan et al. | |
| 2019/0242092 | A1* | 8/2019 | Peloquin | B62D 55/06 |
| 2019/0264399 | A1* | 8/2019 | Ellwein | E01C 19/48 |
| 2020/0032464 | A1 | 1/2020 | O'Donnell | |
| 2020/0064145 | A1 | 2/2020 | McAlpine et al. | |
| 2020/0109527 | A1 | 4/2020 | McAlpine et al. | |
| 2020/0126008 | A1 | 4/2020 | McAlpine et al. | |
| 2020/0256775 | A1* | 8/2020 | White | G01N 33/24 |
| 2020/0327464 | A1* | 10/2020 | Kato | E02F 9/267 |
| 2021/0191413 | A1 | 6/2021 | O'Donnell | |
| 2021/0248539 | A1 | 8/2021 | McAlpine et al. | |
| 2021/0282310 | A1* | 9/2021 | Birkland | B60W 50/14 |
| 2021/0317620 | A1 | 10/2021 | Buschmann et al. | |
| 2022/0169258 | A1* | 6/2022 | Samarthyam | G06Q 50/265 |
| 2023/0020213 | A1* | 1/2023 | Commuri | G01N 33/42 |
| 2023/0183944 | A1 | 6/2023 | Deenathayalan et al. | |
| 2023/0228592 | A1* | 7/2023 | Hong | G01C 21/3822 701/31.4 |
| 2023/0340736 | A1* | 10/2023 | Fritz | E01C 19/48 |
| 2024/0133129 | A1* | 4/2024 | Kauppinen | E01C 19/004 |
| 2024/0199021 | A1* | 6/2024 | Salako | B60W 40/105 |
| 2025/0043522 | A1* | 2/2025 | Smith | E01C 19/4893 |
| 2025/0209574 | A1* | 6/2025 | Yamamoto | G06T 3/00 |

FOREIGN PATENT DOCUMENTS

| | | | | | |
|---|---|---|---|---|---|
| CN | 115491952 | A | * | 12/2022 | G01B 11/0608 |
| DE | 112015004191 | T5 | * | 6/2017 | E01C 7/00 |
| WO | 2017034903 | A1 | | 3/2017 | |

* cited by examiner

CONTROL OF A WORK MACHINE USING GROUND SURFACE WORK RECORDS

TECHNICAL FIELD

The present disclosure relates generally to paving using work machines and, for example, to control of a work machine using ground surface work records.

BACKGROUND

At a worksite, multiple machines can perform a variety of tasks to work a ground surface to construct a roadway, a highway, a parking lot, or the like. For example, in a paving operation, a base layer is prepared by one or more motor graders, dozers, and/or soil compactors, and a paving machine lays down an asphalt mat, or another material, on the base layer that is then gone over by one or more compactors. Generally, it is difficult to track the tasks that have been performed, to track which machines performed the tasks, and/or to monitor whether the tasks were performed adequately (e.g., in compliance with a regulation or an agreed quality). As a result, work may be needlessly duplicated, may be performed inefficiently (e.g., in a sub-optimal order), or may need to be re-done to meet a target level of quality, thereby using excessive machine hours, increasing machine wear, and/or increasing fuel consumption.

China Patent Application Publication No. 110457391A (the '391 publication) discloses collecting and verifying data of vehicles entering/exiting a construction site, and storing the data in a blockchain system. The '391 publication discloses applying blockchain technology to vehicle management of a construction site to guarantee the authenticity of the records of the construction vehicles entering and leaving the construction site. The '391 publication does not address collecting data relating to the activities of the vehicles while the vehicles work at the construction site.

The worksite control system of the present disclosure solves one or more of the problems set forth above and/or other problems in the art.

SUMMARY

A work machine may include a set of ground-engaging members, a steering system, and a controller. The controller may be configured to obtain one or more ground surface work records from one or more databases, the one or more ground surface work records identifying information relating to at least one of base layer preparation, paving, or compacting of a ground surface performed at a worksite by a plurality of work machines. The controller may be configured to determine, based on the one or more ground surface work records, configuration information for a ground surface work operation to be performed by the work machine. The controller may be configured to generate a signal, based on the configuration information, to cause the work machine to perform the ground surface work operation.

A controller may include one or more memories and one or more processors. The one or more processors may be configured to obtain sensor data relating to one or more characteristics of a ground surface being worked at a worksite by a machine. The one or more processors may be configured to identify one or more settings of the machine in use during working of the ground surface. The one or more processors may be configured to generate record information relating to the sensor data and the one or more settings. The one or more processors may be configured to transmit the record information to a data system to cause addition of a record, identifying the record information, to a database.

A method may include obtaining, by a controller, one or more ground surface work records from one or more databases, the one or more ground surface work records identifying information relating to at least one of base layer preparation, paving, or compacting of a ground surface performed at a worksite by a plurality of work machines. The method may include determining, by the controller and based on the one or more ground surface work records, configuration information for a ground surface work operation to be performed by a work machine of the plurality of work machines. The method may include generating, by the controller, a signal, based on the configuration information, to cause the work machine to perform the ground surface work operation or to cause presentation of the configuration information on a display of the work machine.

DETAILED DESCRIPTION

Figure 1:
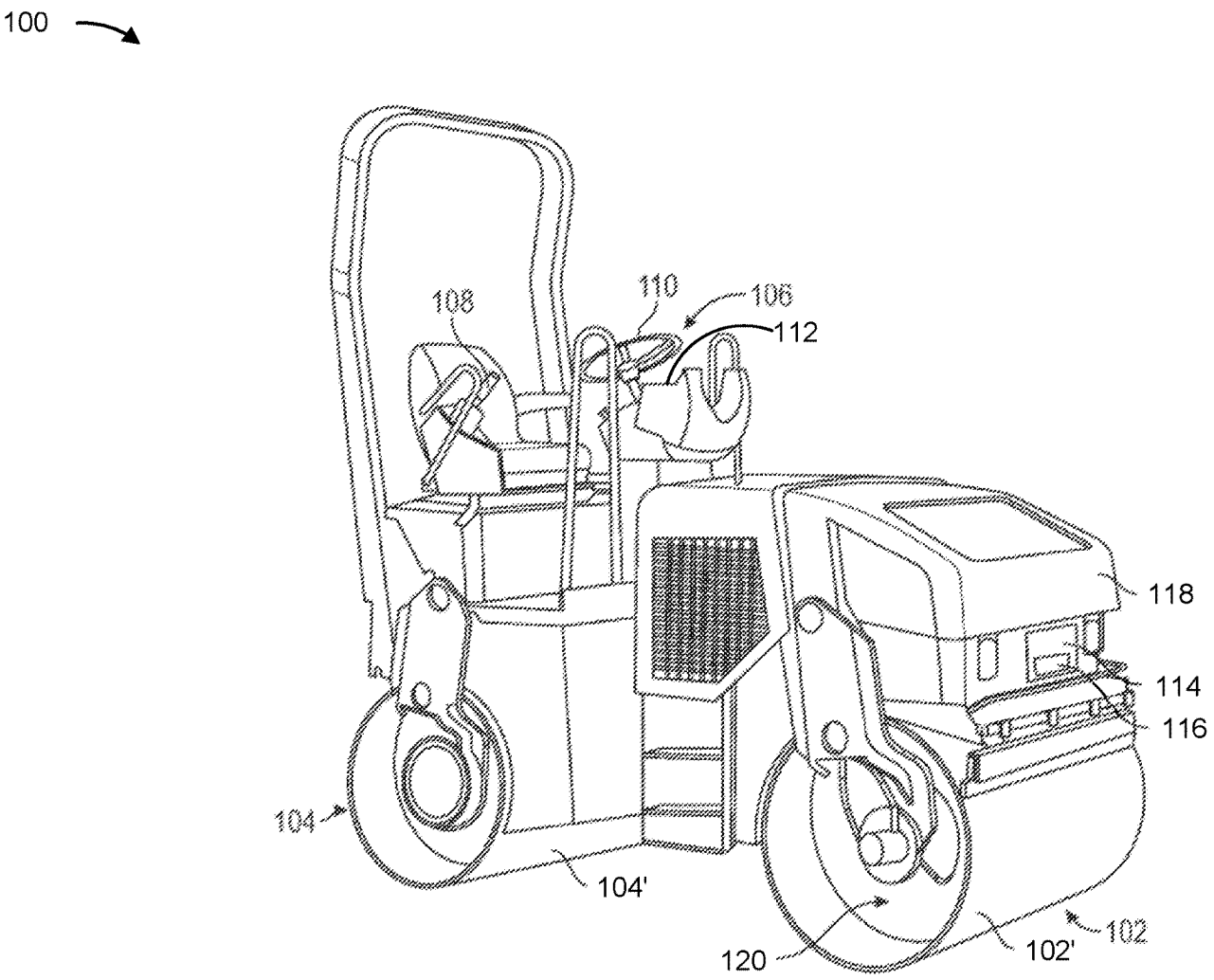
FIG. 1 is a perspective view of an example machine described herein.

FIG. 1 is a perspective view of an example machine 100 described herein. While in FIG. 1 the machine 100 is depicted as a compactor machine, the machine 100 may be another type of machine, such as a cold planer, a soil compactor, a dozer, a motor grader, a paving machine (e.g., an asphalt paving machine or a concrete paving machine), a pneumatic roller, or the like. The machine 100 may be an asphalt compactor machine (e.g., a self-propelled, double-drum compactor machine), a vibratory drum compactor machine, or the like, which may be used to compact various materials, such as soil and/or asphalt, among other examples.

The machine 100 has at least one compaction member, such as a compaction drum. For example, as shown, the machine 100 has a front compaction drum 102 and a back compaction drum 104. The compaction drums 102, 104 are a set of ground-engaging members that provide ground engagement of the machine 100 at surfaces 102', 104' of the compaction drums 102, 104, respectively. The surfaces 102', 104' may include cylindrical surfaces that form exteriors of shells of the compaction drums 102, 104, respectively. As the machine 100 passes over a mat of paving material, the surfaces 102', 104' roll against the paving material and provide compaction forces to the paving material due to a weight of the machine 100. One or more of the compaction drums 102, 104 may include a vibratory component configured to cause the compaction drums 102, 104 to vibrate, thereby further facilitating compaction. In some examples, the machine 100 may include one or more other ground-engaging members, such as one or more wheels and/or one or more tracks, in addition or alternatively to the front compaction drum 102 or the back compaction drum 104.

The machine 100 includes an operator station 106 equipped with various systems and/or mechanisms for control of the operation of the machine 100. For example, the operator station 106 may include a drive system control 108 (shown as a shift lever) and/or a steering system control 110 (shown as a steering wheel). A steering system of the machine 100 may include the steering system control 110, a steering column (e.g., connected to the steering system control 110), a steering actuator (e.g., a steering cylinder for power steering), and/or a steering linkage assembly (e.g., that connects the steering system control 110 or the steering column to ground engagement members, such as the compaction drums 102, 104, via a plurality of linkage members, such as rods). The operator station 106 may also include a display 112 that provides a graphical user interface for operating the machine 100.

The machine 100 includes an engine 114 and a generator 116 coupled with the engine 114. The engine 114 and the generator 116 are attached to a frame 118 of the machine 100. The generator 116 may serve as an electrical power source for various onboard systems and components of the machine 100. The engine 114 may include any type of engine (e.g., an internal combustion engine, a gasoline engine, a diesel engine, a gaseous fuel engine, or the like). The engine 114 is configured to drive movement of the machine 100 (e.g., via compaction drums 102, 104) and other components of the machine 100, such as the generator 116. In some examples, the machine 100 may include an electric motor and an electrical power storage device (e.g., a battery), and/or a fuel cell power source, additionally or alternatively to the engine 114. The machine 100 also includes a braking system 120 configured to receive operator input to decrease or arrest a speed of the machine 100.

As indicated above, FIG. 1 is provided as an example. Other examples may differ from what is described in connection with FIG. 1.

Figure 2:
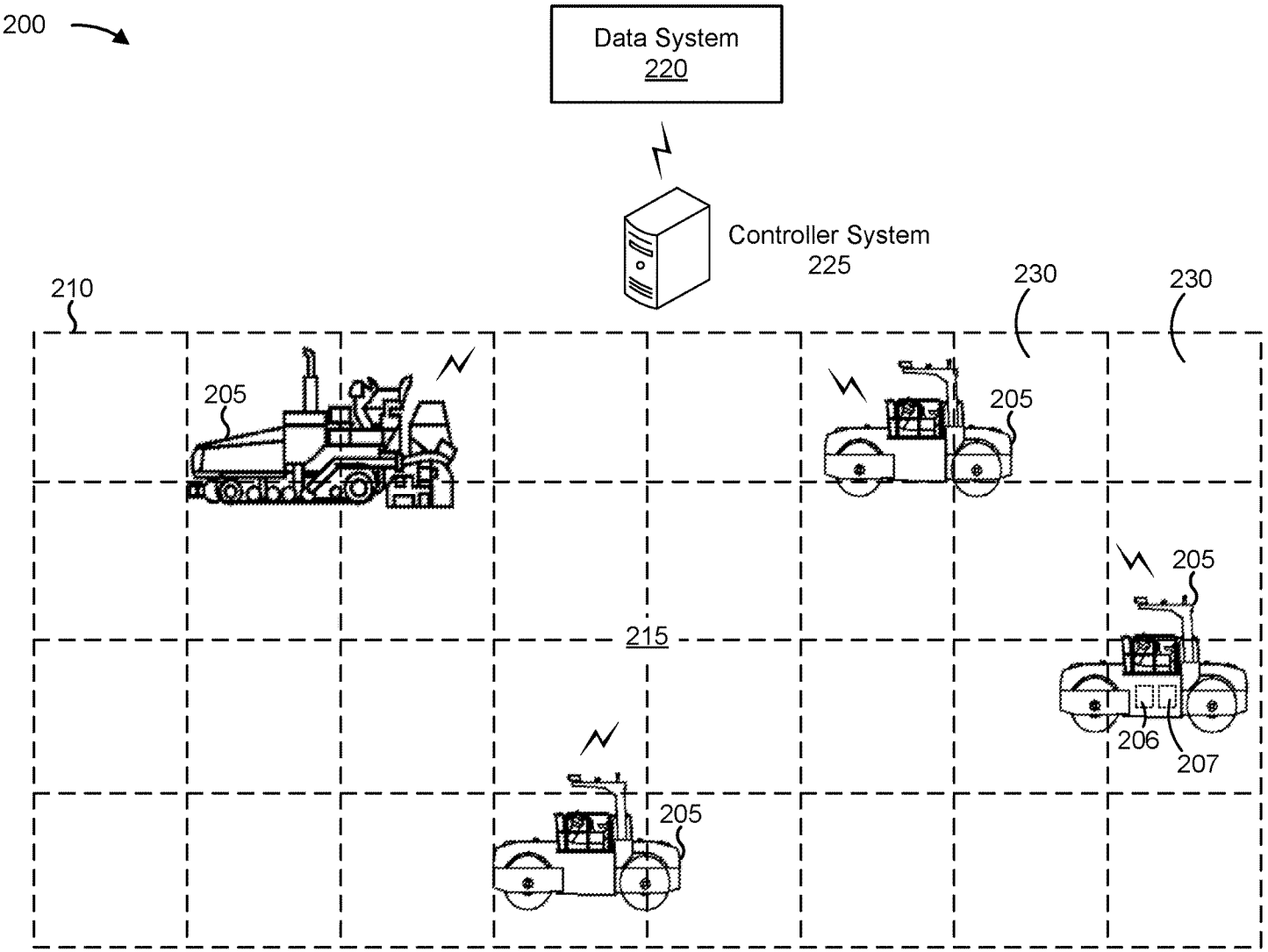
FIG. 2 is a diagram illustrating an example worksite control system described herein.

FIG. 2 is a diagram illustrating an example worksite control system 200 described herein. As shown, a plurality of machines 205 may perform work at a worksite 210 to condition a ground surface 215. For example, each of the machines 205 may perform one or more operations associated with base layer preparation, paving (e.g., asphalt paving or concrete paving), and/or compacting to condition the ground surface 215. Base layer preparation may include grading or otherwise shaping a base layer (e.g., a soil layer) and/or compacting the base layer to prepare the base layer for paving. Paving may include laying an asphalt (or another material, such as concrete) mat on the base layer at a specified depth. Compacting may include compacting the asphalt mat to increase a density and/or smooth a surface of the asphalt mat. The ground surface 215 described herein may refer to the base layer and/or the paving material mat.

The machines 205 may include one or more cold planers, one or more soil compactors, one or more dozers, one or more motor graders, one or more paving machines, one or more compactors, and/or one or more pneumatic rollers, among other examples. For example, the machines 205 may include one or more machines 100. Each of the machines 205 may be equipped with a controller 206 (e.g., an electronic control module (ECM)) and/or one or more sensors 207, shown on just one machine 205 in FIG. 2. A controller 206 may include one or more memories and one or more processors communicatively coupled to the one or more memories. A processor may include a central processing unit, a graphics processing unit, a microprocessor, a controller, a microcontroller, a digital signal processor, a field-programmable gate array, an application-specific integrated circuit, and/or another type of processing component. The processor may be implemented in hardware, firmware, or a combination of hardware and software. The processor may be capable of being programmed to perform one or more operations or processes described elsewhere herein. A memory may include volatile and/or nonvolatile memory. For example, the memory may include random access memory (RAM), read only memory (ROM), a hard disk drive, and/or another type of memory (e.g., a flash memory, a magnetic memory, and/or an optical memory). The memory may be a non-transitory computer-readable medium. The memory may store information, one or more instructions, and/or software (e.g., one or more software applications) related to the operation of the controller 206. A sensor 207 may include a temperature sensor, a density sensor, a durometer, a humidity sensor, a moisture sensor, a speedometer, an accelerometer, an inertial measurement unit, an implement position sensor (e.g., a rotary sensor and/or a linear position sensor), a spectrometer, a magnetometer, a photodetector, a microphone, a pressure sensor, a camera, a radar device, a lidar device, and/or a global navigation satellite system (GNSS) (e.g., a global positioning system (GPS)), among other examples.

The worksite control system 200 may include a data system 220. The data system 220 may include one or more communication devices and/or computing devices that implement one or more data structures, one or more databases, one or more data sources, or another type of data repository. In some implementations, the data system 220 may include a network of computing nodes, and one or more decentralized databases (e.g., one or more blockchains) may be distributed across the network of computing nodes (e.g., each computing node may store copies of the one or more blockchains). Alternatively, the data system 220 may include one or more computing devices that implement one or more centralized databases.

The worksite control system 200 may include a controller system 225. The controller system 225 may be a computing device and/or a communication device. For example, the controller system 225 may be a controller that includes one or more memories and one or more processors communicatively coupled to the one or more memories, in a similar manner as described above. The controller system 225 may be communicatively connected to the machines 205 and to the data system 220 (e.g., by wireless and/or wired connections). For example, the controller system 225 may receive data from the machines 205, format the data for the data system 220, and transmit the formatted data to the data system 220, as well as receive data from the data system 220 and generate commands for the machines 205 based on the data. In some implementations, the worksite control system 200 may omit the controller system 225 and the machines 205 may communicate directly with the data system 220.

Operations described herein may be performed by a controller, which may be the controller system 225 and/or a controller 206 of a machine 205. To initialize the data system 220 in connection with the worksite 210, the controller may determine a logical division of the worksite 210 into a plurality of area units 230 (e.g., the worksite 210 may be logically divided into the plurality of area units 230). Each area unit 230 may represent a geographical area of the worksite 210 (e.g., that has a lesser area than a total area of the worksite 210). For example, an area unit 230 may be represented by a set of geographical coordinates (e.g., latitude and longitude coordinates) or another type of identifier. The area units 230 may be uniformly sized or non-uniformly sized. In one example, an area unit 230 may be a 3 meters×3 meters square, a 1 meter×1 meter square, or the like. In some implementations, the controller may determine the logical division of the worksite 210 into the plurality of area units 230 by referencing an external database, or other data source, that indicates the area units 230 (e.g., indicates an existing area unit division of a city, a state, a country, or the Earth).

The controller may cause a plurality of databases (e.g., blockchains) to be created in connection with the worksite 210. For example, the controller may transmit a configuration for the databases to the data system 220 to cause creation of the databases at the data system 220. As an example, the configuration may indicate schema for a plurality of centralized databases and/or may indicate genesis blocks for a plurality of decentralized databases (e.g., blockchains). Each database may be particular to an area unit 230 of the worksite 210. For example, a first database (e.g., a first blockchain) may be configured to store records only for a first area unit 230, a second database (e.g., a second blockchain) may be configured to store records only for a second area unit 230, and so forth. The controller may generate and store a mapping of area units 230 to databases. In some implementations, a single database may be used in connection with the entire worksite 210 (e.g., the area units 230 are not used).

As operations are performed with respect to the ground surface 215, records may be created in the database(s) that identify the numerous parameters (e.g., inputs) involved in transforming the ground surface 215 into a finished paving material (e.g., asphalt) mat (e.g., for a roadway or a parking lot). The parameters may relate to the ground surface 215, to an operation being performed by a machine 205, and/or to the machine 205. Moreover, the parameters may be static parameters (e.g., parameters that remain consistent throughout an operation being performed by a machine 205) and/or dynamic parameters (e.g., parameters that fluctuate during an operation being performed by a machine 205). To identify the parameters, the controller may obtain sensor data (e.g., from a sensor(s) 207) relating to one or more characteristics of the ground surface 215 being worked at the worksite 210 by a machine 205, and/or one or more characteristics of the machine 205 (e.g., in connection with base layer preparation, paving, and/or compacting of the ground surface 215). Additionally, or alternatively, the controller may identify one or more settings of the machine 205 in use during working of the ground surface 215 (e.g., in connection with base layer preparation, paving, and/or compacting of the ground surface 215).

Parameters relating to a machine 205 may include a brand/model of the machine 205, a unique identifier of the machine 205 (e.g., a serial number), a weight of the machine 205, a type of equipment installed on the machine 205, one or more types of implements installed on the machine 205, a type of prime mover of the machine 205, a fuel type of the machine 205, and/or a type of ground-engaging member of the machine 205, among other examples. In an example where the machine 205 is performing base layer preparation (e.g., the machine 205 is a dozer, a motor grader, or a soil compactor), the parameters may include a soil density, a soil moisture level, a soil material content, a blade position (e.g., a blade angle, a blade pitch, a blade tilt, a blade sideshift, or the like), a travel speed, a transmission gear ratio, a steering angle, a turn radius, a tire pressure, a number of passes, and/or one or more operating modes, among other examples. For example, the operating mode may be an engine mode, an electric mode, an engine-electric motor hybrid mode, an autonomous mode, a semi-autonomous mode, an operator assistance mode, and/or a manual mode, among other examples.

In an example where the machine 205 is performing paving (e.g., the machine 205 is a paver), the parameters may include a mat temperature, a mat density, a mat layer thickness, a mat width, a mat material, an aggregate size of the mat material, a screed position, a cross slope setting, a travel speed, a transmission gear ratio, a steering angle, and/or one or more operating modes (as described above), among other examples. In an example where the machine 205 is performing compacting (e.g., the machine 205 is a compactor), the parameters may include a mat temperature, a mat density, a drum vibration amplitude, a drum vibration frequency, a travel speed, a transmission gear ratio, a steering angle, a turn radius, a tire pressure, a number of passes, and/or one or more operating modes (as described above), among other examples.

The controller may generate record information, for a record for a database (e.g., a block for a blockchain), relating to one or more parameters (e.g., a plurality of parameters) identified by the controller in connection with an operation being performed by a machine 205 at the worksite 210 (e.g., in connection with base layer preparation, paving, and/or compacting of the ground surface 215). The controller may generate such record information throughout the operation being performed by the machine 205. For example, the controller may generate record information periodically or upon one or more triggering events, as described below. In addition to parameters, record information may also identify a machine identifier for the machine 205, an operator identifier for an operator of the machine 205, a timestamp, and/or a location stamp, among other examples.

In some implementations, the controller may detect that a machine 205 (e.g., a compactor) has completed a pass of the ground surface 215 (e.g., according to an operating plan that defines a starting point and an ending point of a pass). For example, the controller may monitor location data associated with the machine 205 (e.g., generated by a GPS, or the like), and the controller may detect that the machine 205 has completed the pass based on the location data. Accordingly, the controller may generate record information for a record responsive to detecting that the machine 205 has completed the pass, and the record information may relate to one or more parameters associated with the pass (e.g., one or more parameters sensed, collected, or identified during the pass). Thus, the controller may generate record information for records relating to each pass of the machine 205. For example, the controller may generate first record information for a first record relating to a first pass of the machine 205, the controller may generate second record information for a second record relating to a second pass of the machine 205, and so forth.

In some implementations, the controller may detect that a machine 205 is located in an area unit 230 (e.g., according to the logical division of the worksite 210 into the plurality of area units 230, described above). For example, the controller may monitor location data associated with the machine 205, and the controller may detect that the machine 205 has moved from a previous area unit 230 to a current area unit 230 based on the location data, in a similar manner as described above. Accordingly, the controller may generate record information for a record responsive to detecting that the machine 205 is located in the area unit 230, and the record information may relate to one or more parameters associated with the area unit 230 (e.g., one or more parameters sensed, collected, or identified in the area unit 230).

Thus, the controller may generate record information for records relating to each area unit 230 into which the machine 205 travels. For example, the controller may generate first record information for a first record relating to a first area unit 230, the controller may generate second record information for a second record relating to a second area unit 230, and so forth. Moreover, each area unit 230 may be associated with a respective database (e.g., a respective blockchain), as described herein.

The controller may transmit record information generated by the controller to a device of the data system 220 (e.g., to a computing node of a blockchain network) to cause addition of a record to a database. The controller may transmit record information as each record information is generated by the controller, or the controller may cache record information and transmit a batch of record information (e.g., at regular intervals or at predefined times). The transmission of record information from the controller may also indicate a database in which the record is to be added. For example, for record information associated with a particular area unit 230, the transmission may indicate a database associated with the area unit 230, or the transmission may indicate the area unit 230 (e.g., the data system 220 may store a mapping of area units 230 to databases). The records added in the database(s) may be referred to herein as "ground surface work records" because the records relate to base layer preparation, paving (e.g., asphalt paving or concrete paving), and/or compacting of the ground surface 215.

In this way, the database(s) may be populated in real time, or near real time, with records relating to numerous aspects of base layer preparation, paving, and/or compacting of the ground surface 215. For example, the records may be associated with each base layer preparation, paving, and/or compacting operation performed by each machine 205 at the worksite 210. Accordingly, as subsequent operations are performed at the worksite 210, the subsequent operations may be performed based on the records in the database(s), and records relating to the subsequent operations may also be added to the database(s), and so forth.

As an example, the controller (e.g., in connection with a subsequent operation) may obtain one or more records from one or more of the databases. As described herein, the records may identify information relating to base layer preparation, paving, and/or compacting performed at the worksite 210 by the machines 205 to work the ground surface 215. In some implementations, to obtain the records, the controller may generate and transmit a query to the data system 220, and the controller may receive a response from the data system 220 that includes the records (e.g., includes the information contained in the records). The controller may obtain records (e.g., by structuring the query) that are filtered according to one or more criteria. For example, the controller may obtain records relating to one or more particular area units 230, relating to one or more particular operation types (e.g., a base layer preparation, a paving, or a compacting operation type, among other examples), relating to one or more particular machine types (e.g., a cold planer, a soil compactor, a dozer, a motor grader, a paving machine, a compactor, or a pneumatic roller machine type, among other examples), relating to one or more particular time periods, relating to one or more particular areas (e.g., as defined by location stamps rather than area units 230), relating to one or more particular machines 205, and/or relating to one or more particular operators, among other examples. Additionally, or alternatively, the records may be filtered by one or more other parameters described herein, such as records relating to a particular mat temperature range, a particular mat density range, or the like.

In some implementations, the controller may obtain multiple records from a single database. Alternatively, the controller may obtain multiple records from multiple databases. For example, the controller may obtain records relating to multiple area units 230, and records for each area unit 230 may be obtained from a respective database (e.g., the controller may obtain multiple records from multiple databases that are respectively associated with multiple area units 230).

The controller may determine, based on the information in the record(s), configuration information for a machine 205. The configuration information may be for an operation that is to be performed, or is being performed, by the machine 205. In other words, the configuration information may provide a configuration that the machine 205 is to use for performing the operation. For example, the configuration information may indicate settings for one or more operating parameters that the machine 205 is to use for performing the operation (e.g., settings for a travel speed, a drum vibration amplitude, a drum vibration frequency, a number of passes, or the like). The operation may be a base layer preparation operation, a paving operation, and/or a compacting operation. Accordingly, the operation may be referred to herein as a "ground surface work operation" because the operation relates to base layer preparation, paving (e.g., asphalt paving or concrete paving), and/or compacting of the ground surface 215.

The controller may determine the configuration information based on parameters indicated in the record(s), such as mat temperature, mat density, number of passes, or the like. Moreover, the controller may determine the configuration information with respect to an operating plan for the worksite 210 and/or with respect to a particular standard (e.g., quality level, regulation, or the like) for the ground surface 215 (e.g., the configuration information may be in furtherance of completing the operating plan and/or achieving the standard). For example, if an operating plan for the worksite 210 indicates that five compaction passes of an asphalt mat are to be performed, and if the parameters indicated in the record(s) indicate that four compaction passes have been performed, then the configuration information may indicate that one additional compaction pass is to be performed. As another example, if a standard for the ground surface 215 indicates a target density for an asphalt mat, and if the parameters indicated in the record(s) indicate that a density of the asphalt mat is below the target density, then the configuration information may indicate a drum vibration amplitude and/or a drum vibration frequency for one or more additional compaction passes (e.g., needed to achieve the target density). In some implementations, the controller may determine the configuration information using a machine learning model trained from numerous historical records (e.g., relating to the worksite 210 and/or relating to a different worksite) that indicate how various parameters of a ground surface change over time as various inputs are provided to the ground surface.

The controller may coordinate operations of the machines 205 using the configuration information. For example, the controller may generate a signal based on the configuration information. The signal may cause the machine 205 to perform the operation (e.g., according to the configuration information). Additionally, or alternatively, the signal may cause presentation of the configuration information on a display of the machine 205 (e.g., display 112 of machine 100). In an example where the controller is the controller system 225, the controller may transmit the signal to a controller 206 of the machine 205 to cause the machine 205 to perform the operation and/or to present the configuration information on the display. In an example where the controller is the controller 206 of the machine 205, the controller may transmit the signal to a system controller of the machine 205 (e.g., a display system controller, a steering system controller, an implement system controller, or the like) to cause the machine 205 to perform the operation and/or to present the configuration information on the display. Accordingly, the machine 205 may perform the operation and/or present the configuration information on the display of the machine 205 based on the signal.

In some implementations, the controller may perform sensor diagnostics and/or data validation based on records in the database(s). The controller may perform the sensor diagnostics and/or the data validation in connection with adding records to a database(s), obtaining records from a database(s), and/or at another time (e.g., at set intervals or in response to a request by an operator of a machine 205 or a supervisor of the worksite 210).

To perform the sensor diagnostics and/or the data validation, the controller may compare sensor data in multiple records to identify a malfunctioning sensor. As an example, a record may identify a first sensor measurement, collected by a first sensor, for a particular characteristic of the ground surface 215 (e.g., temperature, density, moisture content, or the like). Continuing with the example, the same record or a different record (e.g., the first sensor and the second sensor may be different sensors of the same machine 205 or sensors of different machines 205) may identify a second sensor measurement, collected by a second sensor, for the same characteristic of the ground surface 215. The first sensor measurement and the second sensor measurement may have been collected at the same time (e.g., within the same time window) and/or collected at the same location (e.g., in the same area unit 230). Thus, a discrepancy between the first sensor measurement and the second sensor measurement may indicate a malfunctioning sensor.

Accordingly, the controller may determine whether the first sensor measurement corresponds to (e.g., is the same as or is within a tolerance of, such as +1% or +5%) the second sensor measurement, and the controller may determine that the first sensor or the second sensor is malfunctioning based on a determination that the first sensor measurement and the second sensor measurement do not correspond. For example, the controller may determine that the first sensor is malfunctioning if the second sensor measurement corresponds to a third sensor measurement, collected by a third sensor, for the same characteristic of the ground surface 215 (e.g., and collected at the same time and/or the same location as the first sensor measurement and the second sensor measurement).

Based on a determination that a sensor is malfunctioning, the controller may transmit a notification (e.g., to a back-office device) indicating that the sensor is malfunctioning, transmit a service request for the sensor, generate a calendar event for servicing the sensor, and/or disable the sensor (e.g., by turning off the sensor or by discarding measurements collected by the sensor). Additionally, or alternatively, based on a determination that a sensor is malfunctioning, the controller may cause a correction to one or more databases that include records that include sensor data collected by the sensor. In some examples, the controller may determine a time when the sensor first began to malfunction by comparing sensor measurements using a technique similar to that described above for determining whether a sensor is malfunctioning. To cause the correction, the controller may cause (e.g., by transmitting a request to the data system 220) a forking of one or more databases, from the time the sensor first began to malfunction, into new database(s) that omit records with sensor measurements collected by the sensor after the time the sensor first began to malfunction. Additionally, or alternatively, to cause the correction, the controller may cause (e.g., by transmitting a request to the data system 220) one or more new records to be added to one or more databases to nullify sensor measurements collected by the sensor after the time the sensor first began to malfunction.

In some implementations, the controller may determine, based on one or more records, whether an operating plan for the worksite 210 has been completed and/or whether a particular standard for the ground surface 215 has been achieved. Here, the controller may transmit a notification to one or more machines 205 and/or to a back-office device indicating that the operating plan is completed and/or that the standard is achieved (e.g., to cause the one or more machines 205 to cease working of the ground surface 215). In some implementations, the controller may obtain one or more records from the database, may generate information based on the one or more records and/or may format information in the one or more records, and may transmit the information to a device and/or cause the information to be presented on a display of a device. Accordingly, the information can be used by an analyst to determine whether the operating plan is completed, whether the standard is achieved, and/or to conduct a forensic analysis of work operations performed at the worksite 210. For example, using the database(s), secure audits and/or tracking of data may be performed by independent regulatory agencies and/or third party contractors. In some examples, the audited or tracked data may be old data relating to the worksite 210 that was added by unknown parties in connection with previous work performed at the worksite 210. In some examples, an operating plan for the worksite 210 (e.g., used by a current contractor for the worksite 210) may be based on historical records in the database(s) (e.g., added by one or more previous contractors for the worksite 210, and containing information that would otherwise be unknown to the current contractor), thereby eliminating the need for a new worksite survey to be conducted each time a new entity begins work at the worksite 210.

In addition, or as an alternative, to the controller causing addition of records to a database, as described above, records may be added to a database based on manual input. In this case, a database may employ access security measures to prevent individuals or entities, that add records to the database, from retrieving records of the database (or from retrieving records that were added by other individuals or entities). In some examples, records may be manually added by operators and/or supervisors for one or more machines 205 (e.g., based on sensor measurements collected by the machine(s) 205). Accordingly, the worksite control system 200 may be used with mixed fleets that include older equipment and/or include equipment with different makes or protocols (e.g., fleets that include one or more machines 205 that are not enabled to automatically add records to a database). In some examples, records may be manually added based on sensor measurements collected by one or more sensors offboard the machines 205 (e.g., taken by government agents or other compliance regulatory agents). Thus, operations of the machines 205 may be controlled, as described herein, based on a combination of automatically-added records and manually-added records, or based on the manually-added records alone (e.g., which may include official sensor measurements taken by government agents).

As indicated above, FIG. 2 is provided as an example. Other examples may differ from what is described in connection with FIG. 2.

Figure 3:
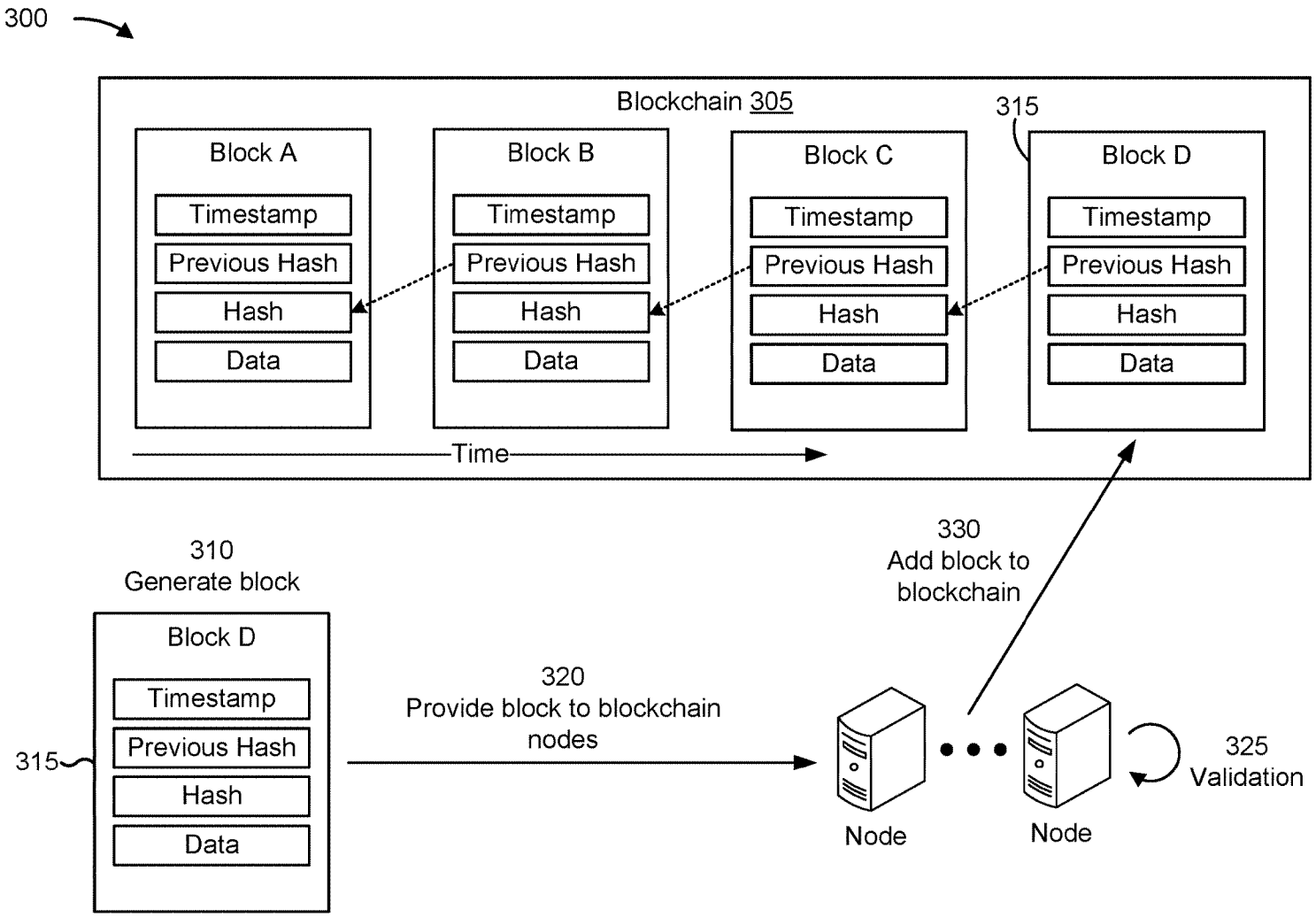
FIG. 3 is a diagram illustrating an example of a blockchain and use thereof.

FIG. 3 is a diagram illustrating an example 300 of a blockchain and use thereof. As shown in FIG. 3, some operations of example 300 may be performed by multiple blockchain nodes (e.g., computing nodes). The blockchain nodes may form a blockchain network, and a blockchain 305 may be distributed among the blockchain nodes of the blockchain network (e.g., each node may store a copy of blockchain 305). Blockchain 305 may be a distributed ledger, or database, that maintains a list of records, called blocks, that may be linked together to form a chain. Blockchain 305 is a decentralized database distributed across the blockchain network of the blockchain nodes.

As shown by reference number 310, a procedure for adding to blockchain 305 may begin with generating a block 315. Block 315 may be generated in response to receiving a request (e.g., from the controller system 225 or a controller 206, described herein) to add information, called a transaction, to blockchain 305. In some implementations, block 315 may be generated by a blockchain node.

As shown, each block of blockchain 305, including generated block 315, indicates a timestamp, a previous hash, a hash, and data, among other examples. For block 315, the data may include the transaction that was requested to be added. For example, the transaction may indicate one or more parameters involved in transforming a ground surface into a finished asphalt mat, as described herein. The transaction may be grouped, in block 315, with one or more other transactions that are awaiting publication to blockchain 305. The timestamp, the previous hash, and the hash may define a header of a block. The hash of a block may be a hash representation (e.g., using one or more hashing methods) of the block's data, and the previous hash may be the hash value in the previous block's header. For example, the previous hash in the header of Block B may be the hash value in the header of Block A, and so forth. Thus, the blocks may be chained together by each block referencing the hash value of the previous block. In this way, an altered block may be easily detected and rejected from blockchain 305, since not all of the current and previous hash values will correspond.

As shown by reference number 320, generated block 315 may be provided (e.g., broadcast) to all blockchain nodes in the blockchain network. As shown by reference number 325, before block 315 is added to blockchain 305, other blockchain nodes may agree that block 315 is valid. For example, the blockchain nodes may reach a consensus on the validity of block 315. To validate block 315, the blockchain nodes may utilize one or more consensus techniques, which may utilize a proof of work (PoW) algorithm, a proof of stake (POS) algorithm, a delegated proof of stake (DPoS) algorithm, and/or a practical Byzantine fault tolerance (PBFT) algorithm, among other examples. As shown by reference number 330, once validated, the blockchain nodes may add block 315 to their respective copies of blockchain 305.

As indicated above, FIG. 3 is provided as an example. Other examples may differ from what is described in connection with FIG. 3.

Figure 4:
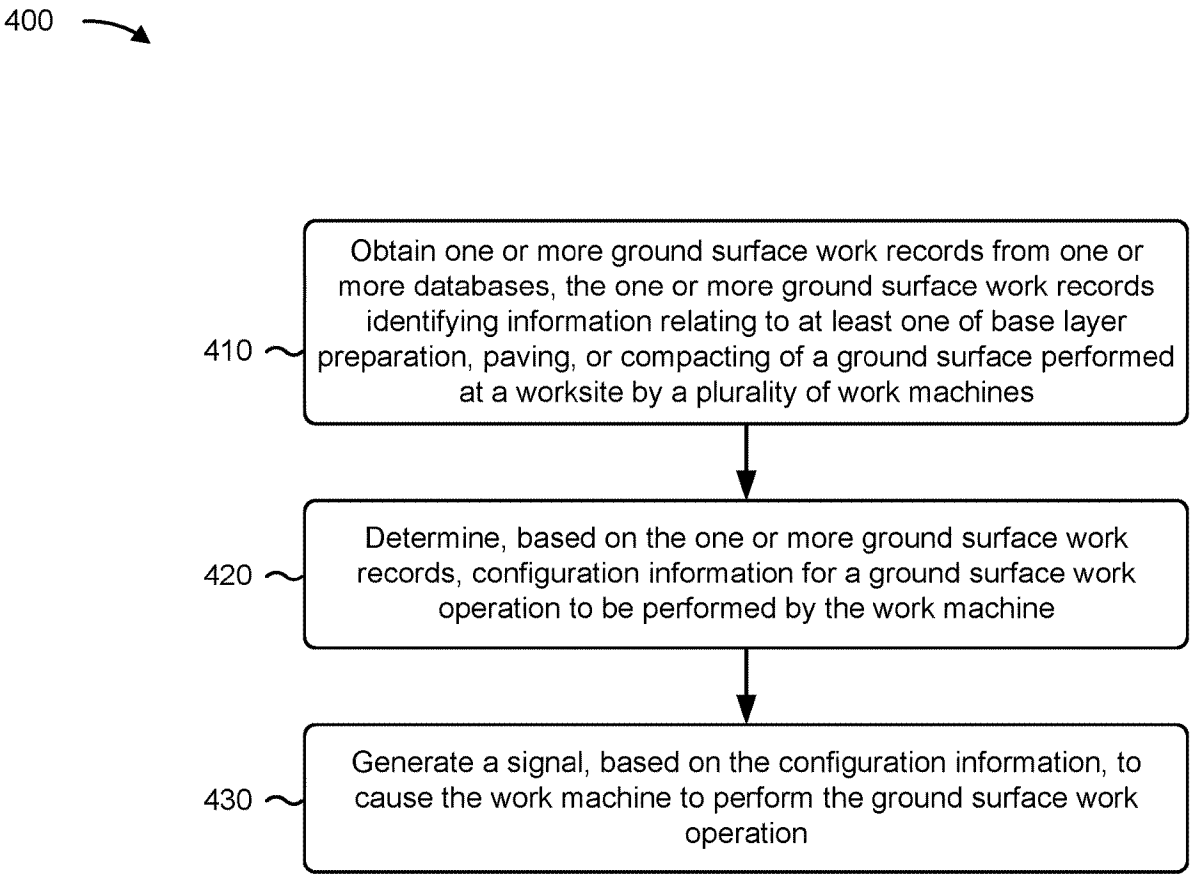
FIG. 4 is a flowchart of an example process associated with control of a work machine using ground surface work records.

FIG. 4 is a flowchart of an example process 400 associated with control of a work machine using ground surface work records. One or more process blocks of FIG. 4 may be performed by a controller (e.g., controller system 225 or a controller 206). Additionally, or alternatively, one or more process blocks of FIG. 4 may be performed by another device or a group of devices separate from or including the controller, such as another device or component that is internal or external to a machine 205.

As shown in FIG. 4, process 400 may include obtaining one or more ground surface work records from one or more databases, the one or more ground surface work records identifying information relating to at least one of base layer preparation, paving, or compacting of a ground surface performed at a worksite by a plurality of work machines (block 410). For example, the controller may obtain one or more ground surface work records from one or more databases, as described above. The worksite may be logically divided into a plurality of area units, and the one or more databases may include multiple databases that are respectively associated with multiple area units of the plurality of area units. The one or more databases may include one or more decentralized databases distributed across a network of computing nodes.

A ground surface work record, of the one or more ground surface work records, may relate to a machine, of the plurality of work machines, and may identify at least one of one or more parameters relating to the ground surface, one or more parameters relating to operations performed by the machine, or one or more parameters relating to the machine. A ground surface work record, of the one or more ground surface work records, may relate to a machine, of the plurality of work machines, and may identify at least one of one or more settings of the machine in use during the base layer preparation, paving, or compacting of the ground surface, or data relating to one or more characteristics of the ground surface during the base layer preparation, paving, or compacting of the ground surface.

As further shown in FIG. 4, process 400 may include determining, based on the one or more ground surface work records, configuration information for a ground surface work operation to be performed by the work machine (block 420). For example, the controller may determine, based on the one or more ground surface work records, configuration information for a ground surface work operation to be performed by the work machine, as described above. The ground surface work operation may be a base layer preparation operation, a paving operation, or a compacting operation.

As further shown in FIG. 4, process 400 may include generating a signal, based on the configuration information, to cause the work machine to perform the ground surface work operation (block 430). For example, the controller may generate a signal, based on the configuration information, to cause the work machine to perform the ground surface work operation, as described above.

The one or more ground surface work records may identify a first sensor measurement, collected by a first sensor, of a characteristic of the ground surface and a second sensor measurement, collected by a second sensor, of the characteristic of the ground surface. In some examples, process 400 may include determining whether the first sensor measurement corresponds to the second sensor measurement, and determining, based on a determination that the first sensor measurement does not correspond to the second sensor measurement, that the first sensor or the second sensor is malfunctioning, possibly with reference to a third sensor, as previously discussed. Process 400 may include transmitting, based on a determination that the first sensor or the second sensor is malfunctioning, a notification indicating that the first sensor or the second sensor is malfunctioning, or a service request for the first sensor or the second sensor. Process 400 may include causing a correction to the one or more databases, where the correction is forking the one or more databases to omit the first sensor measurement or the second sensor measurement, or adding one or more new records to the one or more databases to nullify the first sensor measurement or the second sensor measurement.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

The worksite control system described herein may provide management and/or control of any worksite at which earth moving machinery is used. For example, the worksite control system may be used with a worksite where work machines are preparing an asphalt mat by performing various tasks relating to base layer preparation, paving, and/or compacting. Generally, in asphalt paving, it is difficult to track the tasks that have been performed, to track which machines performed the tasks, and/or to monitor whether the tasks were performed adequately (e.g., in compliance with a regulation or an agreed quality). For example, the work machines involved in preparing the asphalt mat may lack the ability to autonomously coordinate the distribution of tasks among each other. Furthermore, communications between the machines may be unreliable and may lack the robustness needed to efficiently manage and control an entire worksite. As a result, work may be needlessly duplicated, may be performed inefficiently (e.g., in a suboptimal order), or may need to be re-done to meet a target level of quality, thereby using excessive machine hours, increasing machine wear, and/or increasing fuel consumption.

The worksite control system described herein is useful for efficiently managing and controlling ground surface work operations being performed at a worksite. In particular, work machines working a ground surface at a worksite may frequently collect sensor data and collect information relating to settings in use by the work machines, and the worksite control system may create records identifying numerous parameters involved in working the ground surface (e.g., involved in transforming the ground surface into a finished asphalt mat). Based on these numerous parameters, the worksite control system may closely monitor the progress of ground surface work operations being performed at the worksite, and the worksite control system may generate control signals for work machines to coordinate and/or control ground surface work operations of the work machines in an efficient manner. Accordingly, the worksite control system may improve an efficiency of the ground surface work operations and/or reduce duplicated work, thereby conserving machine hours, reducing machine wear, and/or conserving fuel.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A work machine, comprising:
a set of ground-engaging members;
a steering system; and
a controller configured to:
obtain one or more ground surface work records from one or more databases of multiple databases, each of the one or more ground surface work records identifies information relating to at least one of a base layer preparation, a paving, or a compacting of a ground surface performed at a worksite by a plurality of work machines, and each of the multiple databases being associated with a different area unit of a plurality of area units of the worksite;
determine, based on the one or more ground surface work records, configuration information for a ground surface work operation to be performed by the work machine; and
generate a signal, based on the configuration information, to cause the work machine to perform the ground surface work operation.

2. The work machine of claim 1,
wherein the ground surface work operation is a base layer preparation operation, a paving operation, or a compacting operation.

3. The work machine of claim 1,
wherein a ground surface work record, of the one or more ground surface work records, relates to a machine, of the plurality of work machines, and identifies at least one of:
one or more parameters relating to the ground surface,
one or more parameters relating to operations performed by the machine, or
one or more parameters relating to the machine.

4. The work machine of claim 1,
wherein a ground surface work record, of the one or more ground surface work records, relates to a machine, of the plurality of work machines, and identifies at least one of:
one or more settings of the machine in use during the base layer preparation, the paving, or the compacting of the ground surface, or
sensor data relating to one or more characteristics of the ground surface during the base layer preparation, the paving, or the compacting of the ground surface.

5. The work machine of claim 1,
wherein the one or more ground surface work records identify a first sensor measurement, collected by a first sensor, of a characteristic of the ground surface and a second sensor measurement, collected by a second sensor, of the characteristic of the ground surface, and wherein the controller is further configured to:

determine whether the first sensor measurement corresponds to the second sensor measurement; and determine, based on a determination that the first sensor measurement does not correspond to the second sensor measurement, that the first sensor or the second sensor is malfunctioning.

6. The work machine of claim 5, wherein the controller is further configured to:

transmit, based on a determination that the first sensor or the second sensor is malfunctioning, a notification indicating that the first sensor or the second sensor is malfunctioning or a service request for the first sensor or the second sensor.

7. The work machine of claim 5, wherein the controller is further configured to:

cause a correction to the one or more databases, wherein the correction is forking the one or more databases to omit the first sensor measurement or the second sensor measurement, or adding one or more new records to the one or more databases to nullify the first sensor measurement or the second sensor measurement.

8. The work machine of claim 1, wherein the one or more databases comprise one or more decentralized databases distributed across a network of computing nodes.

9. The work machine of claim 1, wherein each of the multiple databases comprises a different blockchain associated with the different area unit.

10. The work machine of claim 1, wherein the one or more ground surface work records identifies at least one of a machine identifier for the work machine, an operator identifier for an operator of the work machine, a timestamp, or a location stamp.

11. A method, comprising:

obtaining, by a controller, one or more ground surface work records from one or more databases of multiple databases, each of the one or more ground surface work records identifies information relating to at least one of a base layer preparation, a paving, or a compacting of a ground surface performed at a worksite by a plurality of work machines, and each of the multiple databases being associated with a different area unit of a plurality of area units of the worksite;

determining, by the controller and based on the one or more ground surface work records, configuration information for a ground surface work operation to be performed by a work machine of the plurality of work machines; and generating, by the controller, a signal, based on the configuration information, to cause the work machine to perform the ground surface work operation or to cause presentation of the configuration information on a display of the work machine.

12. The method of claim 11, wherein the signal is to cause the work machine to perform the ground surface work operation.

13. The method of claim 11, further comprising:

performing the ground surface work operation based on the signal.

14. The method of claim 11, wherein the work machine includes the controller.

15. The method of claim 11, wherein the ground surface work operation is a base layer preparation operation, a paving operation, or a compacting operation.

* * * * *